United States Patent [19]

Wolfel

[11] Patent Number: 4,516,822

[45] Date of Patent: May 14, 1985

[54] ROUND CABLE ADAPTOR FOR MODULAR PLUG

[75] Inventor: Lee A. Wolfel, Greensboro, N.C.

[73] Assignee: AMP Incorporated, Harrisburg, Pa.

[21] Appl. No.: 584,199

[22] Filed: Feb. 27, 1984

[51] Int. Cl.[3] ..... H01R 13/58

[52] U.S. Cl. ..... 339/103 M; 339/176 M

[58] Field of Search ..... 339/103 R, 103 M, 107, 339/176 M, 97 P, 105

[56] References Cited

U.S. PATENT DOCUMENTS 3,761,869 9/1973 Hardesty et al. ..... 339/107 X 4,373,766 2/1983 Johnston ..... 339/176 M X

*Primary Examiner*—Eugene F. Desmond

*Attorney, Agent, or Firm*—F. Brice Faller

[57] ABSTRACT

An adaptor is provided to permit termination of round conductor cables to modular plugs designed to receive flat cables. The adaptor includes a base and comb means to allow cable conductors to be oriented as desired, and strain relief means.

4 Claims, 5 Drawing Figures

2
4
6
7
8
10
11
16
17
20
22
24
26
28
34
36
38
42
50
52
60
62
64
66

ROUND CABLE ADAPTOR FOR MODULAR PLUG

BACKGROUND OF THE INVENTION

The present invention relates to a modular plug as currently used on communications and data transmission cables.

Modular plugs have become quite popular for use on telephone cords and other communications cables and are well accepted throughout the industry. Such a plug is described in U.S. Pat. No. 3,954,320, which is hereby incorporated by reference. These plugs are generally designed for use with flat cable. A portion of the jacket is stripped away, leaving the individual insulated conductors aligned for reception in troughs in the floor of a cavity in the plug and thus aligned for termination with insulation piercing terminals aligned above the troughs. An anchoring member is then locked in place on the cable jacket to provide strain relief for the terminations. This arrangement does not allow for varying the orientation of the conductors vis-a-vis the terminals.

Often it is desirable to use such a plug with a round multiconductor cable, but this presents several problems. A round, jacketed cable will not fit in the cavity profiled for reception of a flat cable and allow room for latching the anchoring member as well. Removing the cable jacket from the portion to be inserted in the cavity leaves too much clearance for the anchoring member to compress the conductors to provide strain relief, and further leaves such a long length of free conductors that it is difficult to align them with the troughs under the terminals.

SUMMARY OF THE INVENTION

The present invention lies in a simple adaptor which permits termination of conductors in a round cable to a modular plug which would otherwise receive flat cable. The adaptor includes a base having a planar surface on which the conductors at the stripped end of a cable may be oriented in any desired order and comb means which maintain the alignment of the conductors for reception in the troughs in the floor of the plug and subsequent termination. The anchoring member then serves not only as strain relief for the conductors but also to bear against the comb means to lock the base in place. A yoke latched to the base serves as strain relief for the cable jacket.

BRIEF DESCRIPTION OF THE DRAWINGS

FIG. 3 is a cross-section taken along line 3—3 of FIG. 2.

DETAILED DESCRIPTION OF THE PREFERRED EMBODIMENT

Figure 1:
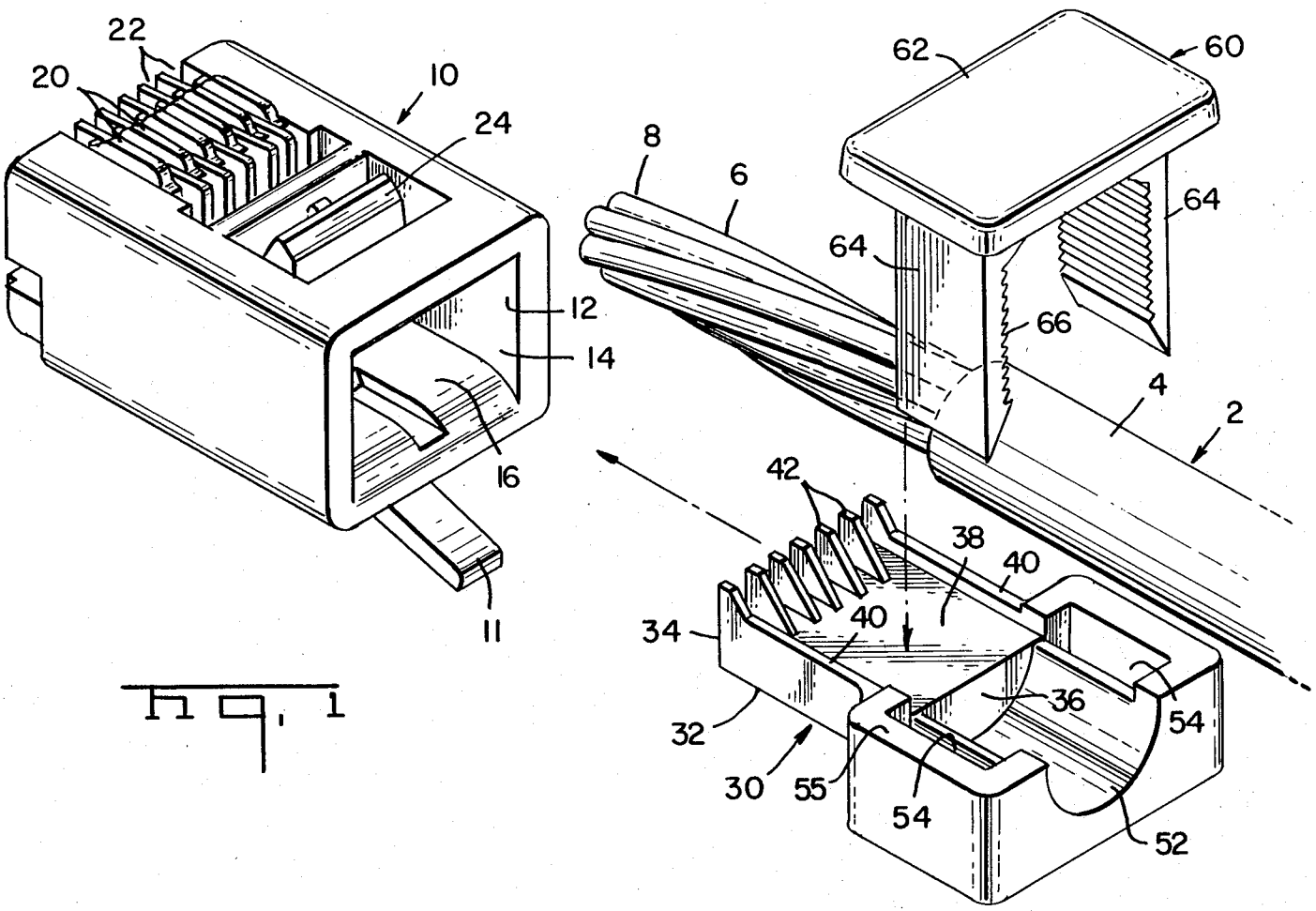
FIG. 1 is an exploded perspective of the adaptor, a round cable, and a modular plug.

FIG. 1 is an exploded perspective of the adaptor, base 30 and strain relief yoke 60 poised for assembly to a round cable 2 and subsequent insertion in cavity 14 of a modular plug 10. These pieces are molded in plastic and will be referred to collectively as the adaptor. The base

Figures 2, 7:
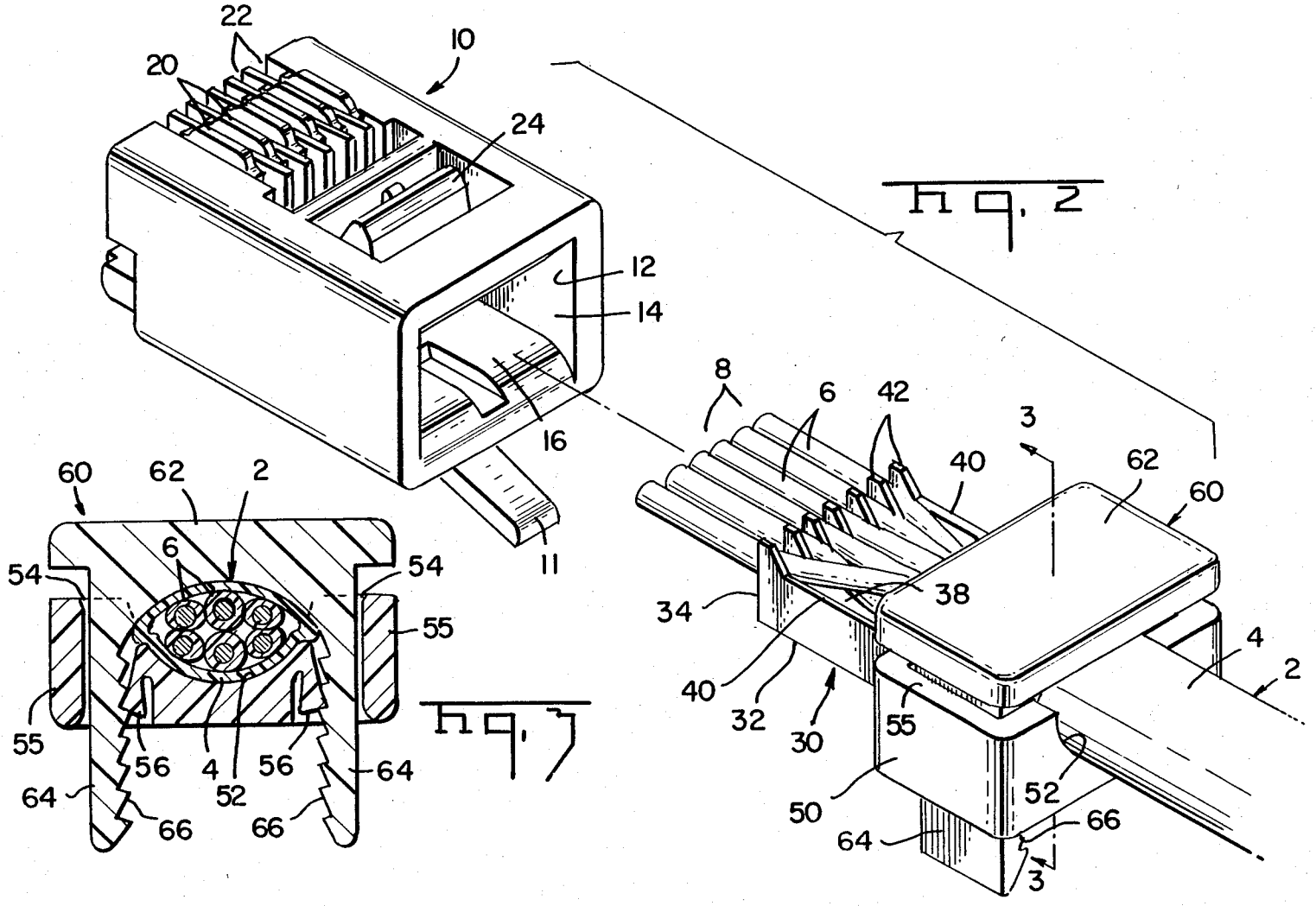
FIG. 2 is a perspective of the adaptor assembled to a round cable with conductors aligned for reception in the plug.

30 has a planar portion 32 with a planar surface 38 thereon bounded by a first end 34, a second end 36, and parallel upstanding sidewalls 40. A series of parallel planar partitions 42 upstanding from the planar surface 38 are spaced to receive individual conductors 6 at the stripped end 8 of the cable 2. The base 30 is molded in plastic and further includes an integral jacket receiving portion 50 having a cylindrical recess 52 therein whose axis is parallel to the planes of partitions 42. The recess 52 serves as a nest for the jacket 4 when conductors 6 are oriented on planar surface 38 and aligned in comb means comprised of partitions 42 and sidewalls 40, as shown in FIG. 2. The recess 52 is flanked by parallel slots 54, which in turn are flanked by sidewalls 55 which bound the jacket receiving portion 50. The slots 54 are profiled to receive the arms 64 extending from cap 62 of strain relief yoke 60. The arms have serrations 66 for latching in the slots.

FIG. 2 shows the yoke 60 assembled to the jacket receiving portion 50. The cap 62 is pressed against the cable 4 as arms 64 latch progressively with latch arms 56 in slots 54 (FIG. 3). This is best accomplished after the conductors 6 are oriented on planar portion 32, as the alignment of the conductors 6 takes a set when the cable 2 is compressed between the jacket receiving portion 50 and cap 62 (FIG. 3). The conductors 6 as shown in FIG. 2 extend beyond second end 34 and are correctly spaced for alignment with terminals 20 which are nested in slots 22, and likewise readily slide into the troughs at the end of floor 16 (see U.S. Pat. No. 3,954,320). Note that the planar portion 32 is profiled for reception in cavity 14 so that lateral movement, which could misalign the conductors 6, is not possible. The plug 10 is a standard type described in U.S. Pat. No. 3,954,320 and is shown with the anchoring member 24 in the open position to permit insertion of the planar portion 32 in the cavity 14. The plug 10 includes a latch 11 for latching with a standard jack.

Figures 4, 5:
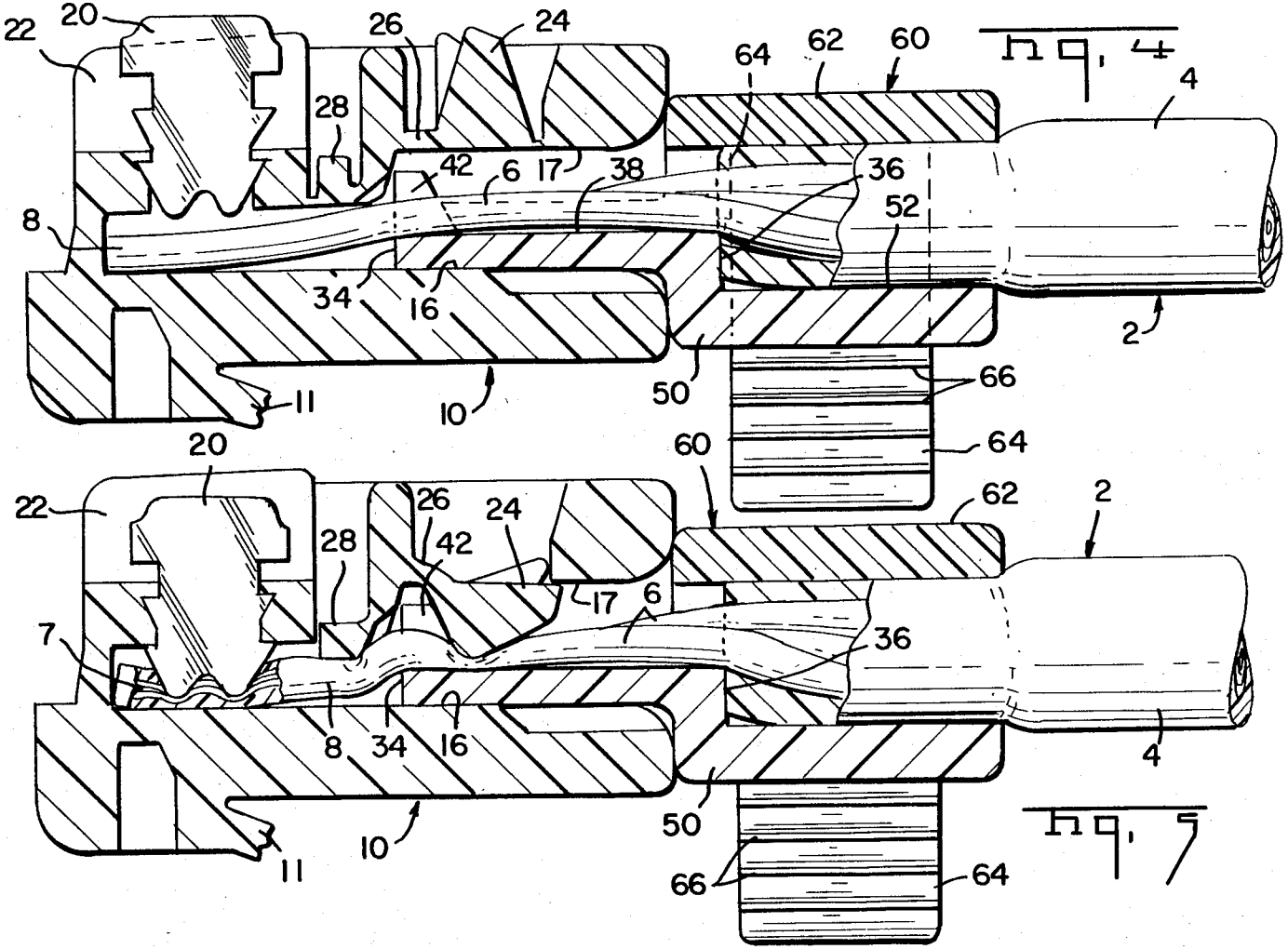
FIG. 4 is a cross-section of the adaptor and cable end in the plug prior to termination and anchoring.
FIG. 5 is a cross-section of the adaptor, plug and cable fully assembled and anchored.

FIG. 4 shows the adaptor assembled on a cable 2 with the planar portion 32 in cavity 14. Note that the second end 36 serves as a stop for the jacket 4 prior to applying yoke 60 so that removing a predetermined amount of jacket 4 assures that the correct length of conductors 6 will be exposed for alignment with terminals 20 without preventing full insertion of the planar portion 32. The anchoring member 24 is still hinged above the conductors 6, as is the restraining bar 28 and terminals 20, which are substantially as disclosed in U.S. Pat. No. 3,954,320.

FIG. 5 shows the plug 10 after the terminals 20 are pressed home to make contact with the conductive strands 7 of respective individual conductors 6. The restraining member 28 has likewise been pushed into place and the anchoring member 24 is shown pivoted downward about hinge 26 and latched under surface 17, which faces the floor 16 of the cavity 14. The latching of anchoring member 24 into place serves two functions: first, it presses the conductors 6 against the surface 38 of base 30, serving as strain relief; second, the anchoring member 24 bears against the partitions 42 to prevent the planar portion 32 from backing out of cavity 14. The adaptor is thus locked in place against the back of the plug 10. Note that this is the same plug which would be used if the jacketed portion of a flat cable were inserted in the cavity 14; the planar portion 32 is just thick enough to compensate for the absence of the jacket, so that a special plug is not necessary for use with a round cable 2 and the adaptor of the present invention. Strain relief for the jacket 4 is provided by the portion 50 in cooperation with yoke 60.

The foregoing is exemplary and not intended to limit the scope of the claims which follow.

I claim:

1. An adaptor for terminating round multiconductor cable to a modular phone plug of the type having an input aperture leading to a cavity, conductor aligning troughs in the floor of the cavity remote from the aperture, terminals in slots aligned above the troughs, and a hinged anchoring member above the cavity towards the aperture, the adaptor comprising:

a base having a planar portion bounded by a first end, an opposed second end, and a planar surface extending therebetween, said base having comb means upstanding from said planar surface at said first end, said planar portion being profiled for reception in said cavity of said plug with said comb means adjacent said troughs, said comb means comprising partitions which space conductors laid on said planar surface in alignment with said troughs, whereby conductors extending through said comb means and beyond said first end will overlie respective troughs when said planar portion is received in said cavity, said comb means being captured in said cavity and said conductors being captured between said anchoring member and said planar surface when said anchoring member is hinged down into anchoring position.

2. The adaptor of claim 1 wherein said base further comprises a jacket receiving portion integral with said planar portion abutting the second end thereof, said jacket receiving portion having a semicylindrical recess axially aligned with said partitions, the surface of said recess lying below said planar surface, whereby said recess serves as a nest for the cable jacket while the conductors of the stripped end of the cable are oriented on the planar surface and in the comb means.

3. The adaptor of claim 2, further comprising a strain relief yoke cooperable with said jacket receiving portion to grip said cable jacket therebetween.

4. The adaptor of claim 3 wherein said jacket receiving portion is flanked by a pair of parallel slots, one on each side thereof, said yoke having a pair of arms for reception in said slots, said arms each being serrated for progressive latching to said jacket receiving portion.

* * * * *